US006013195A

United States Patent [19]

Corazza et al.

[11] Patent Number: 6,013,195

[45] Date of Patent: Jan. 11, 2000

[54] GETTER MATERIALS CAPABLE OF BEING ACTIVATED AT LOW APPLIED TEMPERATURES

[75] Inventors: Alessio Corazza, Camnago Volta; Claudio Boffito, Rho, both of Italy

[73] Assignee: SAES Getters S.p.A., Lainate, Italy

[21] Appl. No.: 08/796,872

[22] Filed: Feb. 7, 1997

[30] Foreign Application Priority Data

Feb. 9, 1996 [IT] Italy ..... MI 96A0254
Dec. 6, 1996 [IT] Italy ..... MI 96A2564

[51] Int. Cl.[7] ..... H01J 7/18; H01J 35/20

[52] U.S. Cl. ..... 252/181.1; 252/181.5; 252/181.6; 252/194

[58] Field of Search ..... 252/181.1, 181.2, 252/181.3, 181.6, 181.7, 194

[56] References Cited

U.S. PATENT DOCUMENTS

| | | | |
|---|---|---|---|
| 3,926,832 | 12/1975 | Barosi | 252/181.6 |
| 4,312,669 | 1/1982 | Boffito et al. | 75/177 |
| 4,360,445 | 11/1982 | Mendelson et al. | 252/181.6 |
| 4,428,856 | 1/1984 | Boyarina et al. | 252/181.1 |
| 4,440,736 | 4/1984 | Maeland et al. | 423/644 |
| 4,559,471 | 12/1985 | Kroontje | 313/553 |
| 4,668,424 | 5/1987 | Sandrock | 252/181.3 |
| 5,312,606 | 5/1994 | Boffito et al. | 423/210 |
| 5,520,560 | 5/1996 | Schiabel et al. | 445/9 |

FOREIGN PATENT DOCUMENTS 8-196899 8/1996 Japan .

*Primary Examiner*—Joseph D. Anthony
*Attorney, Agent, or Firm*—Hickman Stephens & Coleman

[57] ABSTRACT

Compositions containing getter material and getter devices for which gettering activity can be activated at applied temperatures that are lower than those temperatures required for activating the getter material alone are disclosed. In one aspect, a getter composition that includes a getter component and an activator component is provided. The getter component is selected from the group consisting of evaporable and non-evaporable getter materials. The activator component is effective to heat said getter material to a temperature greater than about 500° C. when said activator material is heated to a temperature of between about 280° C. and about 500° C. In some embodiments, the activator component is effective to bring the temperature of the getter material to greater than about 1,000° C. These materials can be used in devices and locations for which low applied activation temperatures are required.

35 Claims, 12 Drawing Sheets

GETTER MATERIALS CAPABLE OF BEING ACTIVATED AT LOW APPLIED TEMPERATURES

BACKGROUND OF THE INVENTION

1. The Field of the Invention

The present invention relates to materials for gettering, or sorbing, various gases. More particularly, the present invention relates to getter materials having low applied activation temperatures, methods for making such materials, and devices including such materials.

2. The Relevant Art

Getter materials are widely employed in applications requiring a high static vacuum or for the purification of inert gases. These materials operate by sorbing molecules of reactive gases which are thus secured and removed from the environment to be evacuated or from the gas to be purified. Getters are subdivided into two main classes: evaporable getters and non-evaporable getters ("NEGs"). Evaporable getters typically include the alkaline earth metals calcium, strontium and especially barium. Non-evaporable getters generally include titanium, zirconium or alloys thereof with one or more metals selected from amongst aluminum and the metals of the first transition row. Both getter types require activation by heating for their operation to remove from the getter surface various oxides, carbides, and nitrides that otherwise prevent the gaseous species to be removed from being sorbed on the getter's surface. Indeed, because of their high reactivity towards atmospheric gases, getters are manufactured and traded in an inactive form and require a suitable activating heat-treatment once they are arranged into the volume to be evacuated.

Evaporable getters are commonly employed in cathode ray tubes ("CRTs") such as used for television and computer monitor screens. In these applications, barium (Ba) is almost always used as the getter metal and is typically deposited as a metal film onto an inner wall of the cathode tube. The activation step resides in the evaporation of the barium metal onto the inner surface(s) of the CRT. Barium evaporation is usually carried out either by heating a barium-containing composition from outside of the cathodic tube, or by exposing the composition to radio-frequency radiation. Generally , the barium-containing composition is $BaAl_4$ which is combined with nickel (Ni) powder. At a temperature of about 850° C. the nickel reacts with the aluminum and the heat generated by such a reaction causes barium to evaporate, according to a so-called "flash" phenomenon.

NEGs are used for several applications, including high-vacuum getter pumps, to maintain vacua in jackets evacuated for thermal insulation purposes, and as gas scavengers inside fluorescent lamps. Often the NEGs are formed into getter bodies of compressed and sintered powders, charged into containers, or laminated onto metal strips. As described above, an activation treatment is generally performed prior to use to remove the thin layer of oxides, carbides and nitrides that accumulate on the surface of the NEG material when the material is exposed to air. Activation by heat-treatment allows these species to migrate towards the getter particle core; thus exposing the metal surface of the particle which is active in gas chemisorption. The activation temperature depends on the composition of the NEG, and can vary from about 350° C., for an alloy having the percentage weight composition of 70% zirconium (Zr)—24.6% vanadium (V)—5.4% iron (Fe), sold under the trade name St 707 by SAES Getters S.p.A. of Lainate (MI) Italy, to about 900° C. for an alloy having a percentage weight composition of 84% Zr—16% Al which is also manufactured and traded by SAES Getters under the trade name St 101®. In general, the activation is performed after the getter material has been placed in its operating environment and the surrounding atmosphere has been at least partially evacuated.

Because both evaporable and non-evaporable getter materials must be activated by heating after the materials are placed into their operating environment, which may contain heat-sensitive instruments or materials, it is often desirable to choose materials that require a relatively low applied heat for activation. For instance, in the case of vacuum jackets made from steel (which have largely replaced the traditional glass vacuum bottles in the market), the steel surface is oxidized by the getter activation step; thus requiring a mechanical cleaning operation to remove the discoloration caused by the accumulated oxidant. This could be avoided if the getter activation could be performed by heating the getter material at a temperature lower than about 300° C. Finally, by working at a lower applied temperature it is possible to use equipment having less complexity and expense than equipment used for high temperature applications and with greater savings in power costs.

However, sometimes getter materials that can be activated at an applied temperature that is lower than the actual activation temperature, but still greater than a minimum temperature, are preferred. In some manufacturing processes, for instance, in the manufacture of television tubes, it would be desirable to have a getter that can be activated at an applied temperature of less than about 850° C. (which is required by the barium evaporable getters presently on the market), but which is not activated during the sealing of the two glass portions forming the cathode tube, which is performed at a temperature of about 450° C., in order to avoid barium evaporation while the device is still open.

The published Japanese patent application Kokai 8-196899 discloses a non-evaporable getter system consisting of a mixture of powders of titanium (Ti), titanium oxide ($TiO_2$) and barium peroxide ($BaO_2$). Both oxides are expected to partially oxidize the titanium metal to form the intermediate oxide $Ti_2O_5$; the heat produced by this reaction should then activate the residual titanium. Preferably from 3 to 5% of silver powder is added to the mixture in order to render the system temperature more uniform. According to this document the disclosed mixture should become activated at a temperature of from 300 to 40020 C. However this solution is not satisfactory. First, the mentioned application discloses only the Ti-$TiO_2$—$BaO_2$ system and the gettering capacity of titanium is not very high. Second, titanium oxide is an extremely stable compound which does not release oxygen and in any case, even if this occurred, the oxygen would merely be transferred from titanium atoms to other titanium atoms with a heat balance of zero; hence without any heat release useful for activating the getter system. Finally the document gives no example demonstrating the activation of titanium getter. In fact, as discussed below, tests performed using the descriptions in this publication failed to show any lowering of applied activation temperature.

SUMMARY OF THE INVENTION

The present invention provides compositions containing getter material and getter devices for which gettering activity can be activated at applied temperatures that are lower than those temperatures required for activating the getter material alone. Thus, the present invention will be seen to provide getter materials that can be used in devices and locations for which low applied activation temperatures are required.

In one aspect, the present invention provides a getter composition that includes a getter component and an activator component. The getter component is selected from the group consisting of evaporable and non-evaporable getter materials. The activator component is effective to heat the getter material to a temperature greater than about 500° C. when the activator material is heated to a temperature of between about 280° C. and about 500° C. In some embodiments, the activator component is effective to bring the temperature of the getter material to greater than about 1,000° C.

In other embodiments, the activator is selected from the group consisting of $Ag_2O$, CuO, $MnO_2$, $Co_3O_4$, and mixtures thereof, and the getter material is a non-evaporable getter material that includes a first component selected from the group consisting of Zr, Ti, and mixtures thereof, and a second component selected from the group consisting of V, Cr, Mn, Fe, Co, Ni, Al, Ni, Ta, and W. More specific embodiments are those for which the getter alloy is selected from the group consisting of Zr—Al, Zr—Fe, Zr—Ni, Zr—Co, Zr—V—Fe, and Zr—Mn—Fe alloys. Still more specific embodiments are those for which the getter alloy is the ternary alloy having the composition, by weight, Zr 70%—V 24.6%—Fe 5.4%; the binary alloy having the composition, by weight, Zr 84%—Al 16%; the binary alloy having the composition, by weight, Zr 76.6%—Fe 23.4%; or the binary alloy having the composition, by weight, Zr 75.7%—Ni 24.3%.

In some embodiments, the activator components is selected from the group consisting of $Ag_2O$, CuO, $MnO_2$, $Co_3O_4$, and mixtures thereof. In still other embodiments, the getter composition of the invention includes a third component which is a an alloy containing at least one component selected from the group consisting of rare earth metals, Y, La, their mixtures, and another component which is Cu, or Sn, or a mixture thereof. Yet other embodiments include those for which the getter element is an evaporable getter element, and, in more particular embodiments, the getter is the barium-containing alloy having the formula $BaAl_4$.

In another aspect, the present invention provides getter devices that comprise the getter compositions of the invention.

These and other aspects and advantages of the present invention will become more apparent when the Description below is read in conjunction with the accompanying Drawings.

BRIEF DESCRIPTION OF THE DRAWINGS

FIGS. 1 and 4 illustrate tablet configurations of getter and activator or activator/alloy materials respectively.

FIGS. 2 and 5 illustrate arrangements of getter and activator or activator/alloy components placed in containers respectively.

FIG. 3 illustrates an embodiment in which the getter and activator components are arranged on a support.

DESCRIPTION OF SPECIFIC EMBODIMENTS

Figure 1:
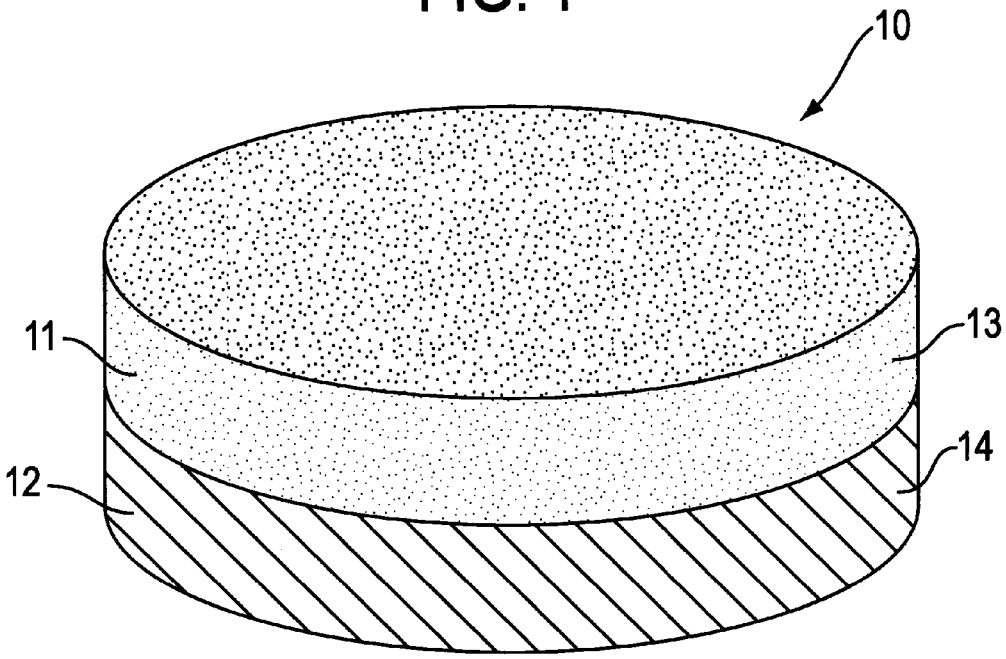
FIGS. 1–6 show possible alternative embodiments of getter systems in accordance with the invention.

The present invention provides, in one aspect, compositions including a getter component and an activator component for which the getter component can be activated at applied temperatures lower than those required for activating the getter material alone. Thus, the compositions of the invention will be seen to provide getter materials that can be used in situations in which the applied activation temperatures of getter materials alone are incompatible with environment in which the getter material is required to operate.

In one embodiment, the present invention provides two-component getter compositions including a getter component that is selected from the group consisting of evaporable and non-evaporable getter materials and an activator component that is effective to heat the getter material to a temperature greater than about 500° C. when the activator component is heated to a temperature between about 280° C. and about 500° C. In some embodiments, the getter material can reach temperature of greater than about 1,000° C. when the activator is heated to a temperature of between about 280° C. and about 500° C. In other embodiments, the getter composition of the invention can include a third component that is an alloy containing at least one component selected from the group consisting of rare earth metals, Y, La, their mixtures, and another component which is Cu, or Sn, or a mixture thereof.

The evaporable getter material can be any material known to function as an evaporable getter. Such materials include, but are not limited to, compounds comprising an element chosen from among calcium, strontium and barium. Preferably such compounds are in the form of an alloy to limit the reactivity of these elements to air. One useful evaporable getter material is the intermetallic compound $BaAl_4$, which further can be admixed with nickel powder and, possibly, small quantities of Al, Fe, Ti, or their alloys. Other evaporable getter materials will be familiar to those having skill in the gettering arts.

Similarly, the non-evaporable getter material can be any material known to those of skill in the gettering arts to function as a non-evaporable getter. Such materials can include alloys comprising zirconium (Zr), titanium (Ti), or mixtures thereof, and at least one other element chosen from among vanadium (V), chromium (Cr), manganese (Mn), iron (Fe), cobalt (Co), nickel (Ni), aluminum (Al), niobium (Nb), tantalum (Ta), and tungsten (W). In some embodiments zirconium-based based alloys are used, such as the binary alloys Zr—Al, Zr—Fe, Zr—Ni, Zr—Co, or the ternary alloys Zr—V—Fe and Zr—Mn—Fe. More particular embodiments include those for which the non-evaporable getter material is one of the above-mentioned St 101® or St 707 alloys. Other particular embodiments include those for which the getter material has the percentage weight composition Zr 76.6%—Fe 23.4%, or Zr 75.7%—Ni 24.3%.

The activator component of the getter composition of the invention can include any material that can undergo an exothermic reaction that is effective to heat the getter material to at least the activation temperature of the getter material when heated to an applied temperature that is less than the activation temperature of the getter material. In one embodiment, this temperature is between about 280° C. and about 500° C. The reaction can be between the materials of the activator component and the getter component, or it can be a reaction within the activator component itself. In more specific embodiments, the activator component is an oxide chosen from among the oxides $Ag_2O$, CuO, $MnO_2$, $Co_3O_4$, or mixtures thereof. Still other activator materials can be determined using techniques known to those of skill in the chemical and metallurgical arts.

It will be appreciated that the reaction of the activator and getter components to provide heat required for activation of the getter material will, in some cases, consume getter material (typically, in the case where the activator is an oxide, by the conversion of the getter material to a corresponding oxide). Thus, in some embodiments it may be useful to provide an excess of getter material. In one embodiment, the ratio by weight between the getter material and the oxide is between about 10:1 and about 1:1. Ratios higher than about 10:1 can contain an amount of oxide that is insufficient to obtain efficient activation of the getter material. With ratios lower than about 1:1, an excessive quantity of getter material may be oxidized; thus risking loss of getter capacity in the device for which the getter is intended to function. Furthermore, an excess of oxide produces more heat than that necessary for activating the getter and thus is a waste of material.

In one embodiment, the getter and activator materials are powders having particle sizes of less than about 150 $\mu$m. In another embodiment, the particle sizes are less than about 50 $\mu$m. According to one embodiment, the two components are mixed to form a completely homogeneous mixture. Alternatively, the activator, which is generally the minority component, can be concentrated substantially in a region of the getter material with the remainder of system being formed substantially of getter material. In such an embodiment, it will be appreciated that it is possible to prepare a substantially homogeneous mixture of the activator with a portion of the getter material, e.g., obtaining a local region of mixture in which the weight ratio of the two materials is about 1:1, then contacting that mixture with the remaining portion of getter material.

It will be appreciated that the efficiency of heat transfer to the getter material from the exothermic reaction between the two components of the combination is the more effective for arrangements of getter and activator materials in which the contact area between the activator and the portion of getter material intended to react with the activator is relatively large. For those embodiments for which the activator is dispersed homogeneously in the getter material, relatively large contact surfaces can be achieved using fine particle sizes. For those embodiments which are divided into portions comprising a substantially homogeneous getter portion and a substantially heterogeneous getter/activator portion, the use of fine particle sizes can be limited to the latter. In this case, however, the efficiency of heat transfer will be a function of size of the contact surface between the two portions of the system.

Figure 2:
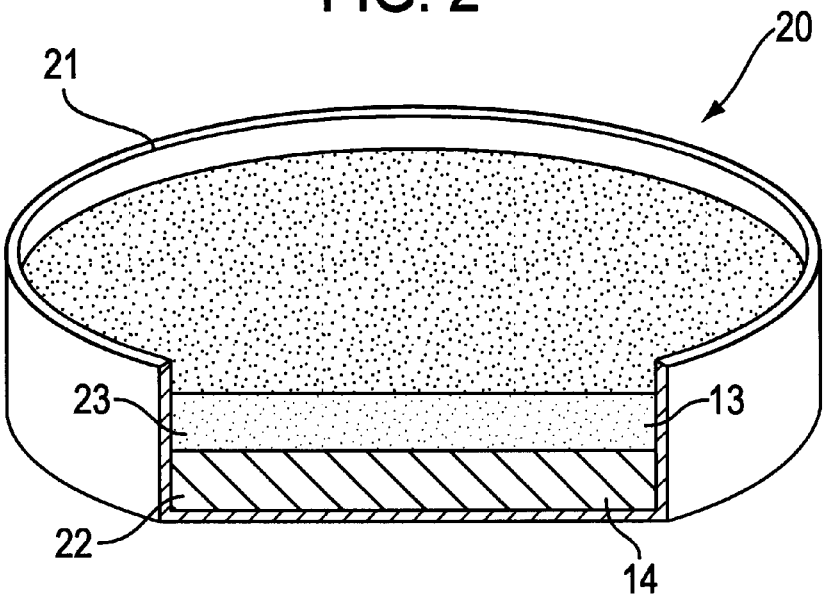
Figure 3:
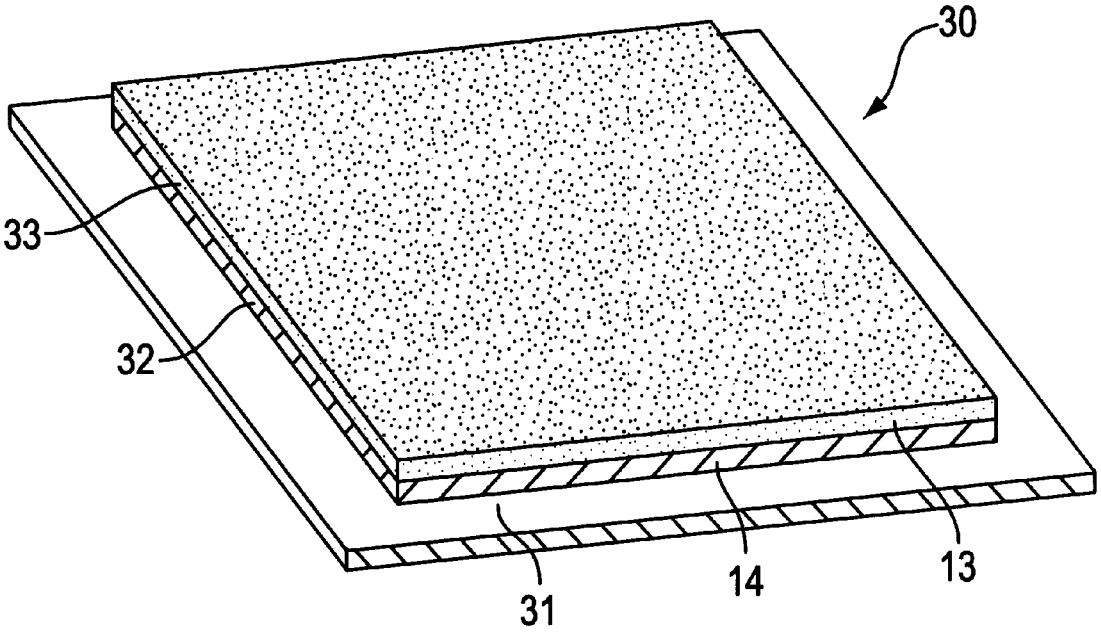

FIGS. 1 to 3 show some possible embodiments of getter devices including combinations of materials according to the invention for which the activator is not homogeneously distributed throughout the getter material. The fabrication of such devices can be performed using methods and materials known to those of skill in the gettering arts.

FIG. 1 illustrates an embodiment of getter device that includes a tablet 10 comprising layer 11 of a getter material 13 and a layer 12 of a combination 14 of the invention, formed from a substantially heterogeneous mixture of the above-described activator (e.g., one of the above-listed oxides) and a getter material.

In FIG. 2 another embodiment of a getter device in accordance with the present invention is shown at 20. Device 20 includes a container 21, open at its upper side, the lowermost portion of which a layer 22 contains a combination 14 of getter and activator materials with a layer 23 substantially of getter material 13 thereupon. Such an embodiment is suitable for use with both evaporable and non-evaporable getter materials.

FIG. 3 illustrates still another embodiment of a getter device at 30. According to this embodiment, device 30 is essentially planar and includes a planar support 31 upon which a layer 32 of a combination of getter and activator materials 14 is deposited. Deposited over this is layer is a second layer 33 of a getter material 13. Such devices can be employed either with evaporable getter materials or with NEG materials and are particularly suitable for maintaining vacua in evacuated enclosures having narrow widths, such as field emitter devices.

In some embodiments the getter composition of the invention includes a third component which is chosen from among metals or other substances that are capable of undergoing exothermic reaction with the above-described activator component to provide a temperature sufficient to activate the getter component under heating at an applied temperature less than the temperature of getter activation. It will be thus appreciated that the inclusion of such a third component allows for the activation of the getter material at a lower applied temperature without the loss of significant amounts of getter material. In one embodiment, the third component is an alloy containing at least one component selected from the group consisting of rare earth metals, Y, La, their mixtures, and another component which is Cu, or Sn, or a mixture thereof. In a more specific embodiment, the third component is selected from among the Cu—Sn—MM alloys, where "MM" designates the material known in the metallurgical arts as "mischmetal", which is a mixture of rare earths containing cerium, lanthanum, neodymium and lesser amounts of other rare earths and is available commercially. Other suitable materials can be determined using methods known to those of skill in the chemical and metallurgical arts.

For those embodiments for which the third component is a Cu—Sn—MM alloy, the weight ratio of copper to tin and mischmetal may range within wide boundaries. In one embodiment, the alloy has a weight content of mischmetal ranging between about 10% and about 50%. The content of copper and tin may be present individually or in admixture in any ratio with each other and their combined weight in the alloy may range from about 50% to about 90%. In one embodiment, the Cu—Sn—MM alloy is in the form of a powder having a particle size lower than about 150 $\mu$m. In a more specific embodiment, the particle size is lower than about 50 $\mu$m. In some embodiments in which the activator is one of the above-listed oxides, the oxide and the Cu—Sn—MM alloy are in combined in a highly heterogeneous mixture. In such embodiments, fine particle sizes are often useful. The mixtures may then be compressed to form tablets, placed in open containers, or deposited onto flat carriers to which a getter material in a suitable geometry is added to yield complete getter devices.

In three-component combinations of materials, the weight ratio between the activator and the alloy may range widely. For embodiments in which the activator is one of the above-listed oxides and the alloy is a Cu—Sn—MM alloy, useful ratios are between about 1:10 and about 10:1 and, more specifically, between about 1:5 and about 5:1. The weight ratio between the getter component and the activator/alloy mixture depends on the geometry of the getter and on the particular materials being used. As discussed above, the transfer of the heat generated in the exothermic reaction between the activator and the alloy to the getter material is a function of the size of the contact area between the materials. The required amount of activator/alloy mixture is generally proportional to the activation temperature of the particular getter material being used. For instance, the activation St 707 alloy requires an amount of oxide/Cu—Sn—MM mixture which is less than that required for the activation of the cited St 101® alloy or for barium evaporation.

Figure 4:
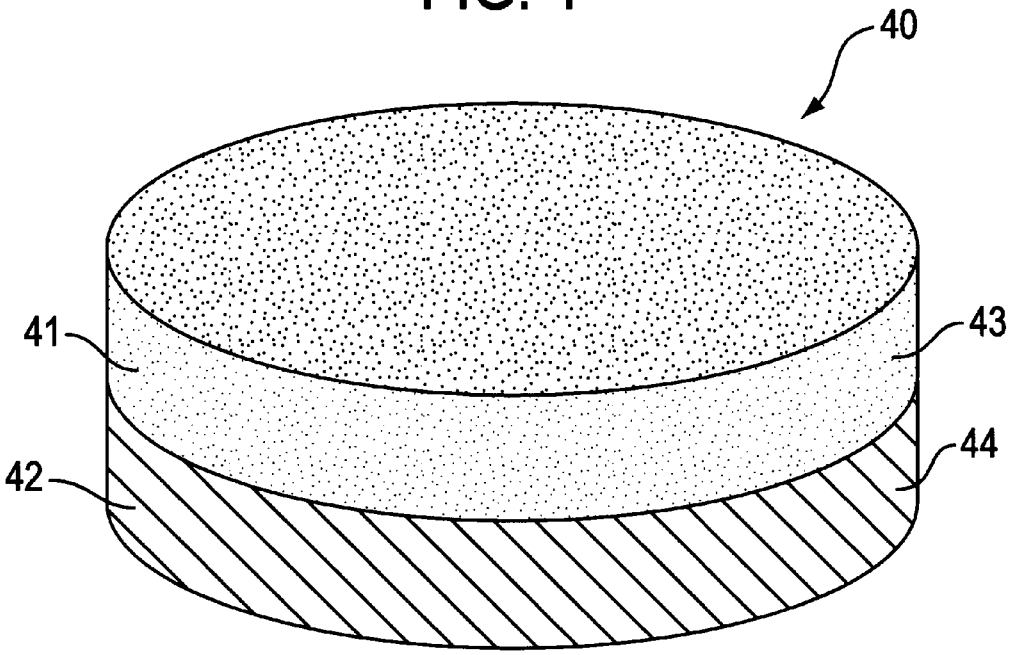
Figure 5:
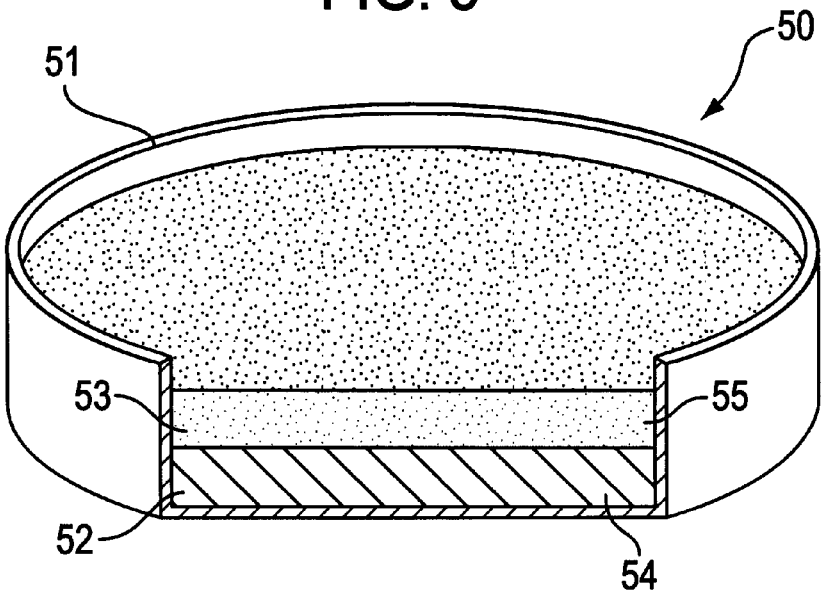
Figure 6:
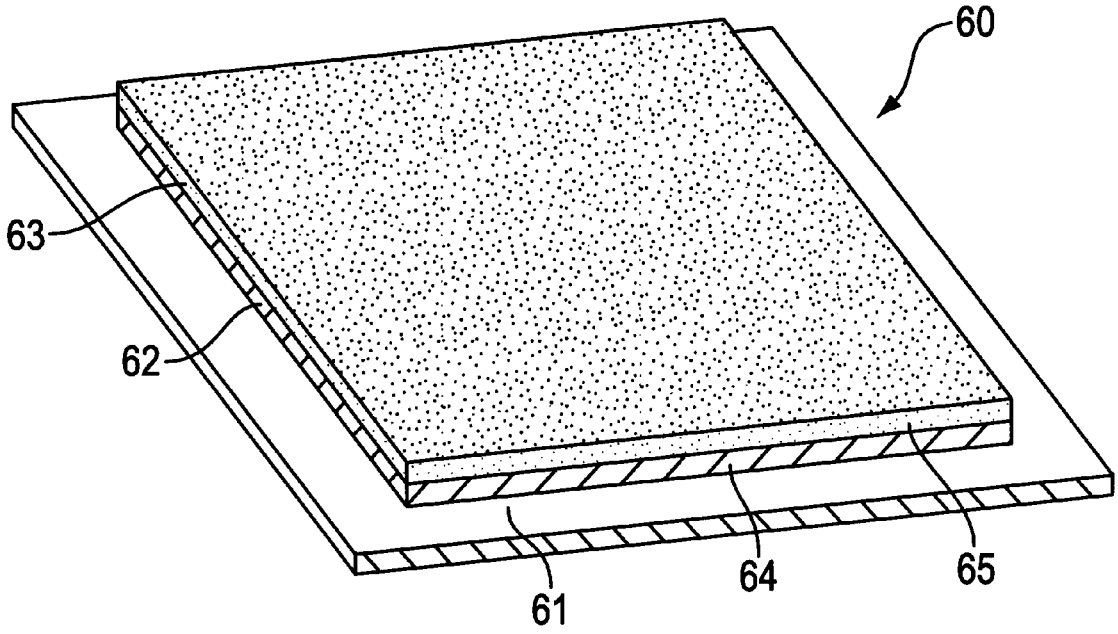

Some possible getter devices using three-component mixtures are represented in FIGS. 4–6. It will be appreciated that even though the geometries represented in FIGS. 4–6 are similar to those of FIGS. 1–3, these do not represent the only possible geometries for the devices of the invention.

FIG. 4 shows a getter device 40 formed of a layer 41 of a getter material 43 and a layer 42 of a mixture 44 of activator and the above-described third component alloy. FIG. 5 illustrates another getter device embodiment 50 which includes an open container 51 the lowermost portion of which contains a layer 52 of the mixture 54 of activator and third component alloy. A layer 53 of getter material 55 is deposited over the activator/alloy mixture. FIG. 6 illustrates a further embodiment of a getter device 60, substantially in planar form, including a metal carrier 61 upon which a layer 62 of mixture 64 of activator and third component alloy is deposited. A layer 63 of getter material 65 is deposited over the activator/alloy combination. The fabrication of such devices can be performed using methods and materials known to those of skill in the gettering arts.

The heating of these devices to the triggering temperature of the reaction between the activator or activator/alloy materials of the invention can be performed using conventional means known to those of skill in the gettering arts. For example, heating from outside the evacuated chamber can be accomplished using a radio-frequency generator, or by inserting the chamber into an oven. Alternatively, it is also possible to incorporate heaters into the getter devices themselves. Such incorporated heating elements can include electrically insulated electric wires, which can be heated by means of a current flow.

EXAMPLES

The following examples describe specific aspects of the invention to illustrate the invention and aid those of skill in the art in understanding and practicing the invention. However, these examples should not be construed as limiting the invention in any manner.

Example 1

Figure 7:
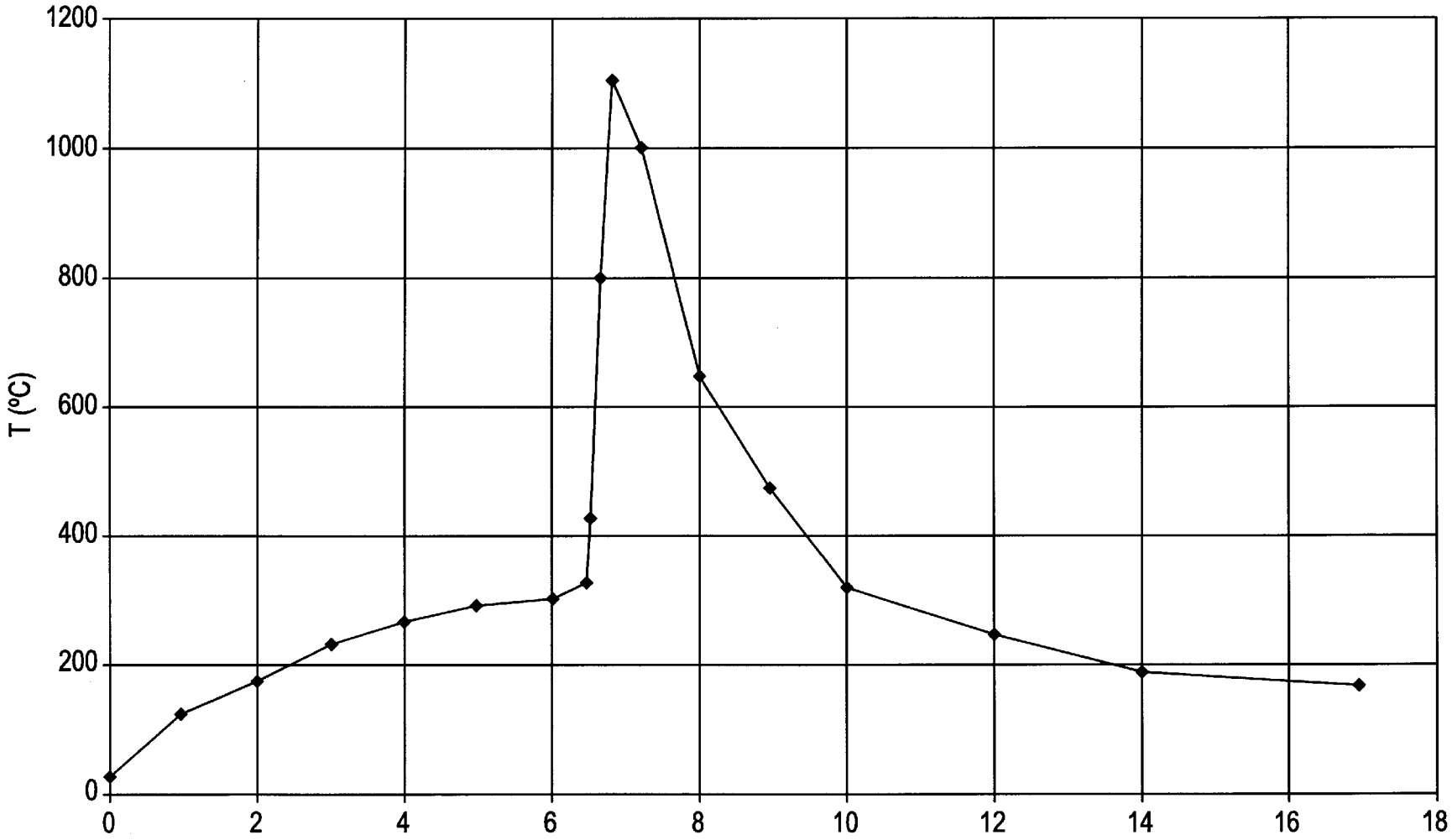
FIG. 7 is a graph showing the temperature profile of a combination of materials of the invention as a consequence of heating.

About 50 milligrams (mg) of powdered St 707 alloy (having the composition 70% Zr—24.6% V—5.4% Fe by weight and available commercially from SAES Getters S.p.A. of Lainate (MI) Italy) was mixed with about 50 mg of silver oxide ($Ag_2O$) powder. Both of the powders had particle sizes of less than about 150 micrometers ($\mu$m). The powder mixture was compressed at about 3000 kg/cm$^2$ to form a tablet, referred to hereinbelow as "Sample 1". A thermocouple was placed in contact with the sample. Sample I was fitted into a metal sample carrier and put into a glass flask connected to a vacuum system. Upon evacuating the flask, Sample 1 was heated by means of a coil placed outside the flask. By causing electric current to flow in the coil, the sample carrier and the alloy were heated by electromagnetic induction. The temperature measured by the thermocouple was recorded against time starting from the moment current began to flow through the coil. The temperature values are plotted on the graph of FIG. 7.

Example 2

Figure 8:
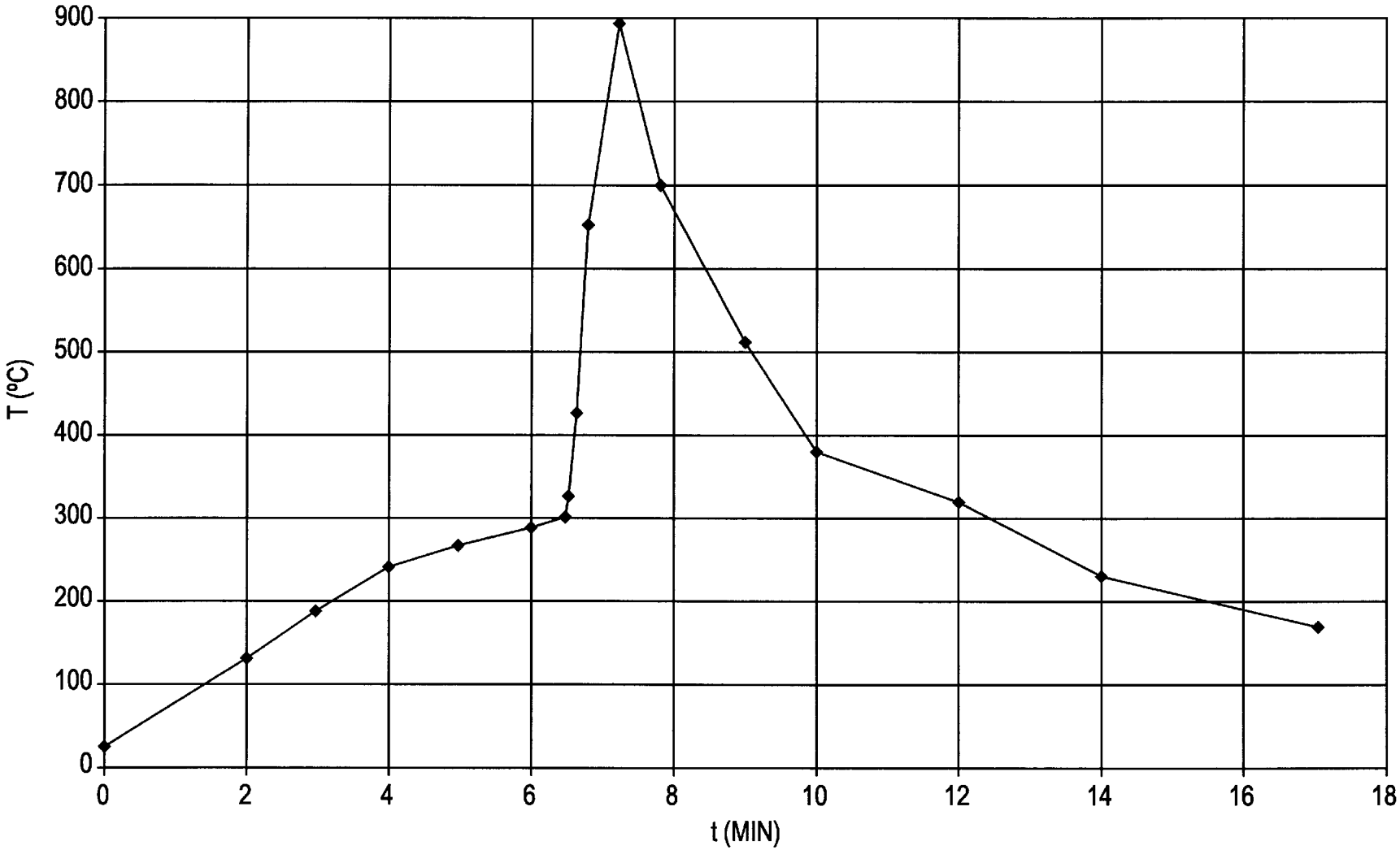
FIG. 8 is a graph showing the temperature profile of another combination of materials of the invention as a consequence of heating.

The procedure of Example 1 was repeated using a sample ("Sample 2") consisting of about 100 mg of powdered St 707 alloy and about 7.5 mg of $Ag_2O$. Test results are plotted in the graph of FIG. 8.

Example 3

Figure 9:
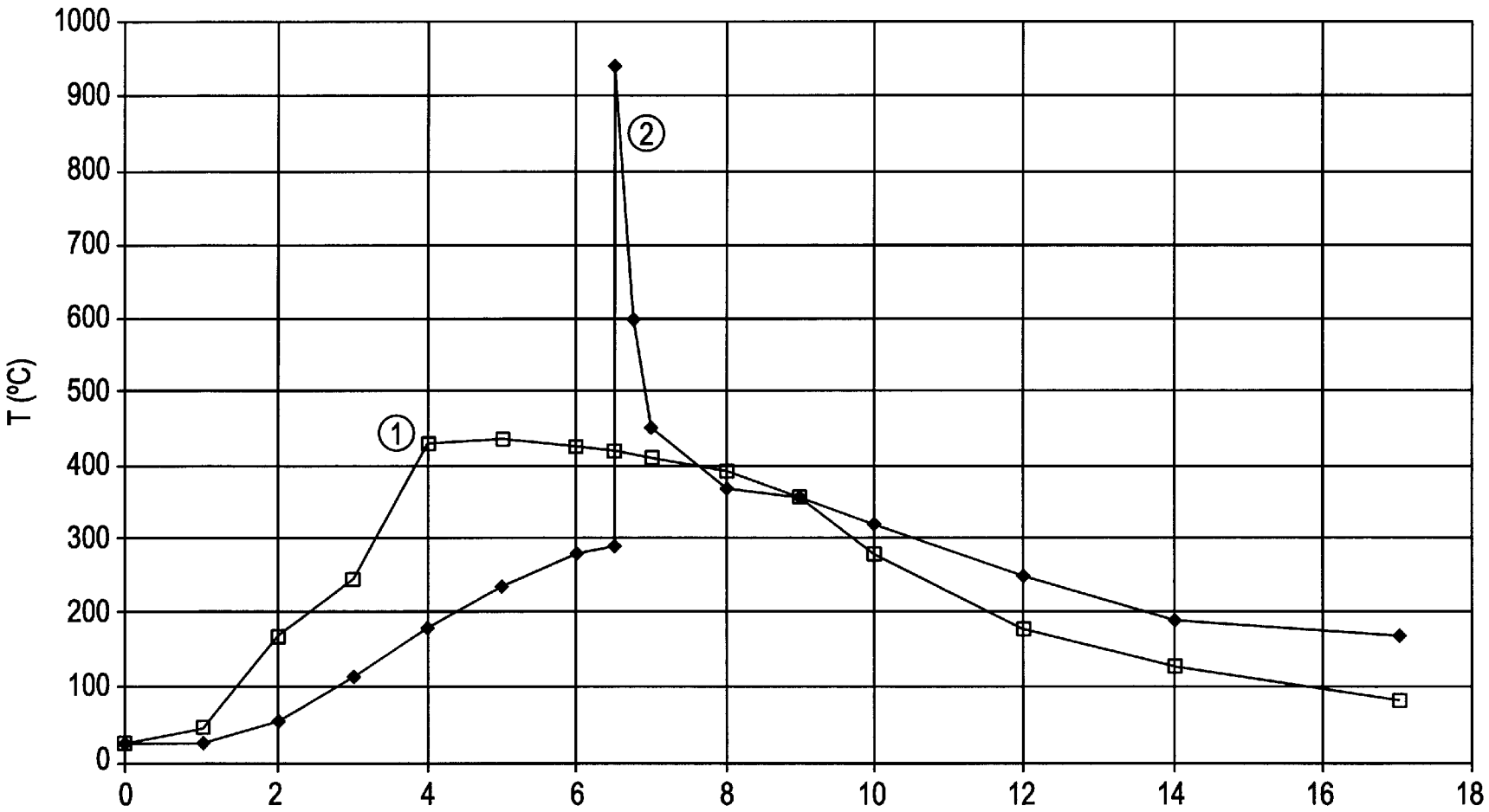
FIG. 9 is a graph showing the temperature profile of a further combination of materials of the invention and of the atmosphere of the oven in which the combination is heated.

About 150 mg of $Ag_2O$ powder was mixed with about 150 mg of a powdery alloy having the percentage weight composition 40% Cu—30% Sn—30% MM (where "MM" denotes mischmetal). Both of the powders had a particle size of less than about 150 $\mu$m. The powder mixture was compressed at a pressure of about 3000 kg/cm$^2$ to form a tablet ("Sample 3"). Sample 3 was fitted into a metal container and the combination was put into an evacuated oven that contained two thermocouples. The first thermocouple was positioned in a region of the oven that was far from the sample; and the second one placed in contact with the sample. The oven was heated and the temperature values of the two thermocouples were recorded as a function of time as shown in FIG. 9. Line 1 denotes the readings taken for the first thermocouple, measuring the temperature of the oven atmosphere. Line 2 denotes the readings taken for the second thermocouple, measuring the temperature of the sample.

Example 4

Figure 10:
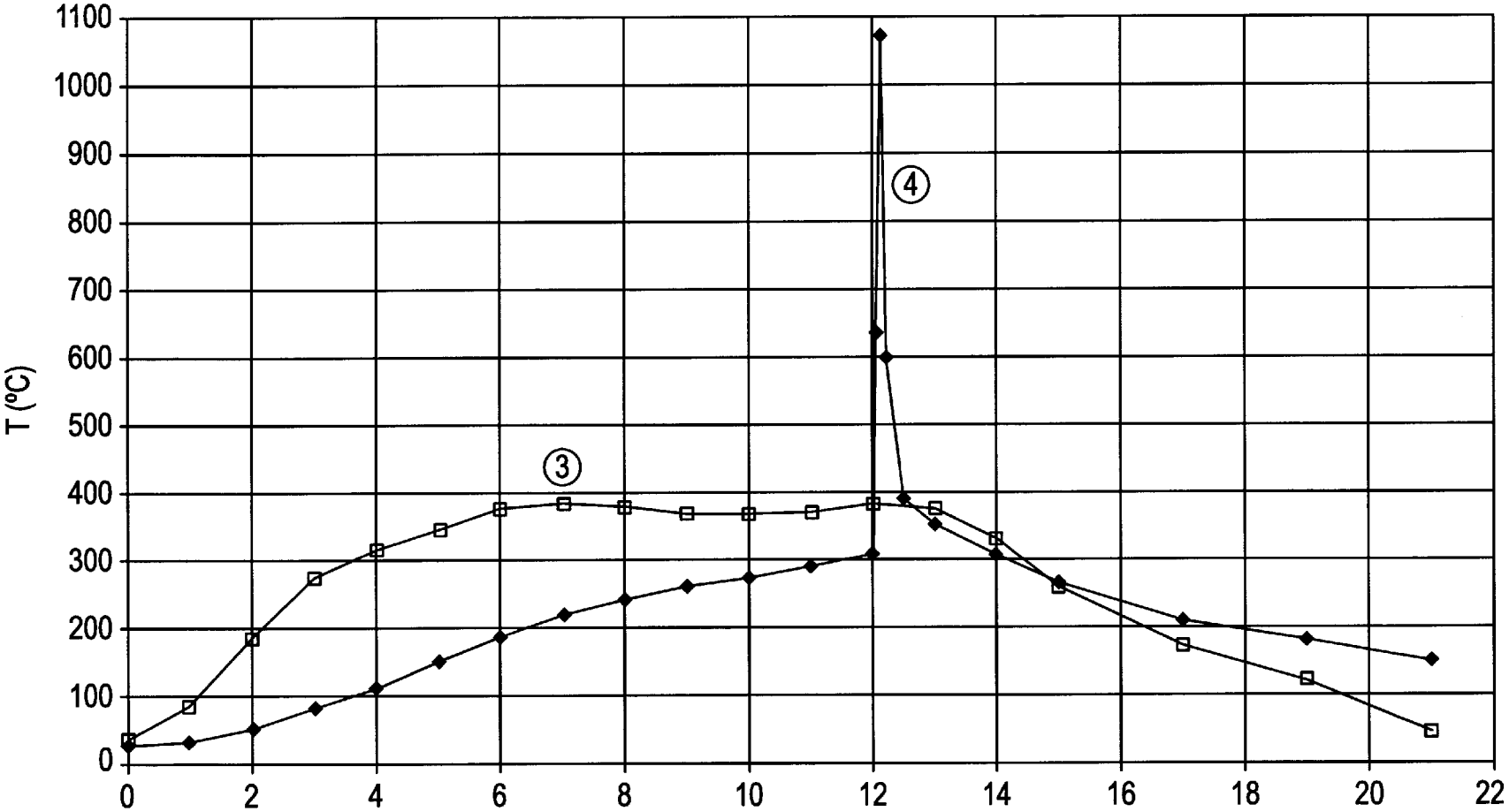
FIG. 10 is a graph showing the temperature profiles of a further combination of materials of the invention and of the atmosphere of the oven in which the combination is heated.

The procedure of Example 3 was repeated, using a sample ("Sample 4") that was prepared as described above for Example 3, but in which $Ag_2O$ was replaced by an equivalent weight of CuO. The test results are recorded in the graph of FIG. 10 as line 3, showing the profile of the temperature measured by the thermocouple far from the sample; and as line 4, showing the profile of the temperature measured by the thermocouple contacting the sample.

Example 5

Figure 11:
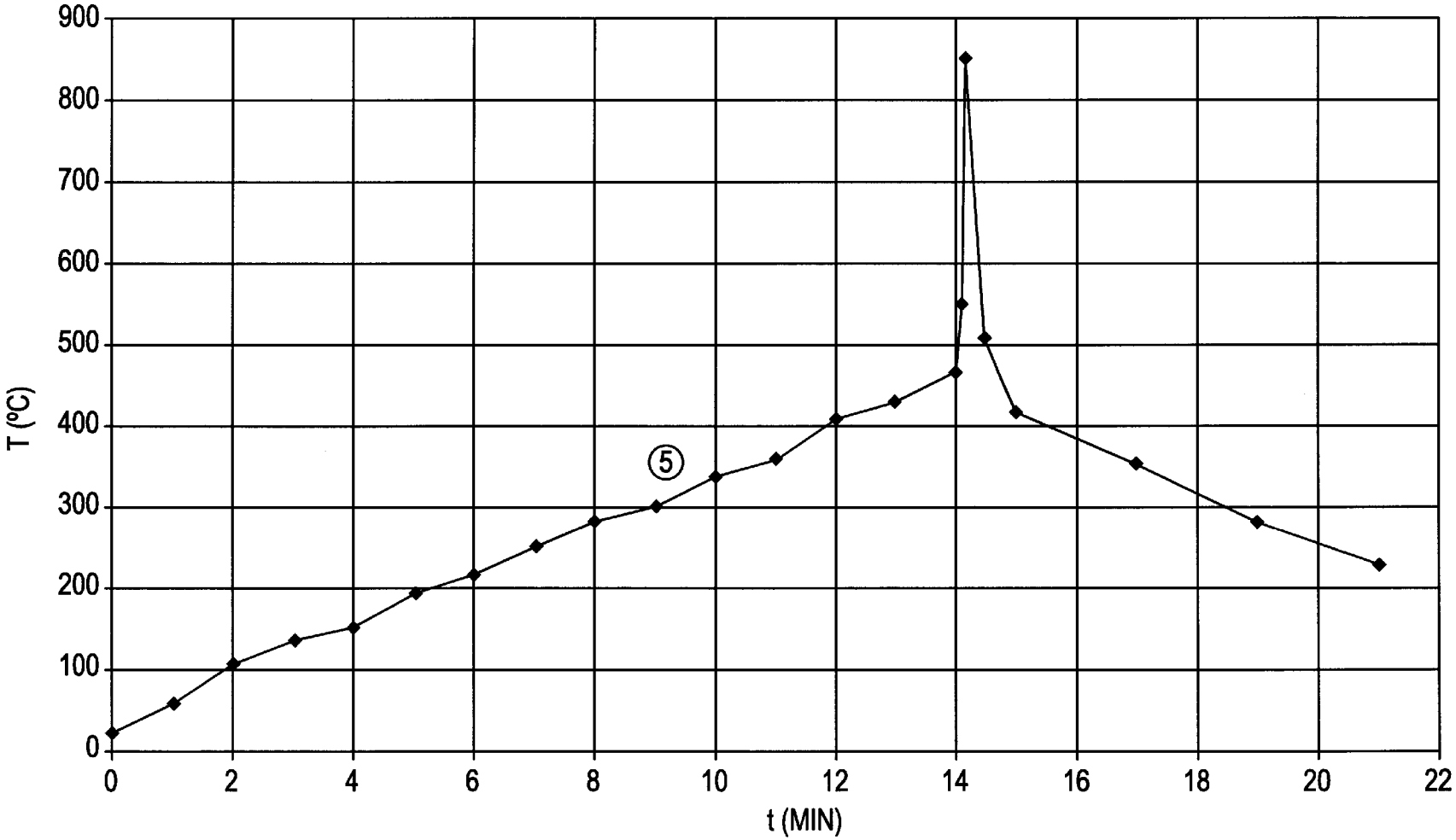
FIG. 11 is a graph showing the temperature profile of still another combination of materials of the invention as a consequence of heating.

The procedure of Example 3 was repeated, using a sample ("Sample 5") that was prepared by replacing $Ag_2O$ with $MnO_2$. Sample 5 is fitted into the sample carrier made from metal and inserted into a glass bulb connected to a vacuum system. After evacuating the bulb, Sample 5 was subjected to induction heating by means of an induction coil located outside the bulb. In this case, since the interior of the bulb was not heated, only one thermocouple was used, measuring the variation of the sample temperature. Temperature values of the sample during the test are recorded as line 5 in FIG. 11.

Example 6

A test series was carried out by using different inventive combinations of materials. In these tests of different mixtures of oxides and the alloy of Example 3 (Samples 6–11), were compressed into a ring-shaped container. Tests were carried out in an evacuated glass bulb as described in Example 5. Sample number, weight percentages of the components of the different mixtures, and the temperatures triggering the exothermic reaction for the different compositions were recorded as shown in Table 1. Temperatures shown in the Table have an uncertainty of ±5° C., because of difficulties in positioning the thermocouple near the sample.

TABLE 1

| Sample No. | Oxide | Alloy (%) | Trigger Temperature (° C.) |
|---|---|---|---|
| 6 | $Ag_2O$ | 50% | 283 |
| 7 | $Ag_2O$ 20% + CuO 20% | 60% | 325 |
| 8 | CuO | 70% | 340 |
| 9 | CuO 25% + $MnO_2$ 25% | 50% | 475 |
| 10 | $MnO_2$ 25% | 75% | 470 |
| 11 | $Co_3O_4$ 30% | 70% | 400 |

Example 7 (Comparative)

In this example the activation behavior of a sample prepared according to the Japanese patent application Kokai 8-196899 was evaluated.

The procedure of Example 1 was repeated using a sample ("Sample 12") obtained by stirring about 100 mg of titanium powder, about 2 mg of powdered titanium oxide and about 5.5 mg of powdered barium peroxide. Test results were plotted in FIG. 12.

Example 8

About 700 mg of St 707 alloy (described above), about 200 mg of $Ag_2O$, and about 200 mg of the CuO—Sn—MM alloy of Example 3, each in the form of a powder having a particle size of less than about 150 gm were combined as follows. The powders of CuO—Sn—MM alloy and $Ag_2O$ were mixed by mechanical stirring, charged into a metal container having a diameter of about 1.5 cm and lightly compressed so as to provide cohesion among the particles of powder. The St 707 powder was poured onto this layer and the whole combination was compressed at about 3000 kg/cm$^2$ ("Sample 13"). The sample was inserted into a glass bulb which was then placed in an oven connected to a manometer and, through a series of cutoff valves, to a pumping system and to a gas metering line. The system was evacuated and heating was started until a thermocouple contacting the container recorded a temperature of 290° C. The oven was switched off and the sample was allowed to cool down to room temperature. The system was isolated from the pumping system and a gas sorption test was carried out by feeding subsequent hydrogen doses according to the procedures described by Boffito, et al. in the article "The Properties Of Some Zirconium Based Gettering Alloys For Hydrogen Isotope Storage And Purification", *Journal of the Less-Common Metals*, 104:149–157(1984). The results are recorded on the graph in FIG. 13 as line 6.

Example 9 (Comparative)

The test of Example 8 was repeated in which only the St 707 getter alloy was used. The getter was activated according to conventional methods by subjecting the alloy to an induction heating of about 500° C. for about 10 minutes. The sorption line measured on this activated alloy is recorded on the graph of FIG. 13 as line 7.

Example 10

About 200 mg of a powder mixture, containing about 47 percent by weight $BaAl_4$ and about 53 percent by weight nickel, and about 800 mg of the mixture $Ag_2O$/Cu—Sn—MM alloy of Example 3 were weighed. The $Ag_2O$/Cu—Sn—MM alloy mixture was placed onto the bottom of a metal container such as the one described in Example 8 under a slight compression so as to provide cohesion among the particles of powder. Over the thus formed layer, a layer formed by the powder of the above $BaAl_4$/Ni mixture was deposited. The sample was inserted into a glass flask with a 1 liter (L) volume and a manometer. The flask was coupled, through cutoff valves, to a pumping system and a gas metering line. The flask was evacuated and the sample was subjected to induction heating. At a temperature of about 300° C., measured by means of a thermocouple contacting the metal container, the formation of a barium metal film on the inner surface of the flask was observed. The system was allowed to cool down and a CO sorption measurement was performed according to the procedures of the standard technique ASTM F 798-82. The test result is recorded on the graph of FIG. 14 as line 8.

The behaviors of some combinations of the invention and of the prior art are recorded in the graphs of FIGS. 7–12. Each of the graphs shows a common temperature profile, characterized by a steady temperature rise over the initial part of the test, followed by a sudden temperature increase. Without wishing to be bound to any theory of action, it is believed this sudden increase of temperature is due to the heat released by reactions between the activator and getter (and/or alloy) materials constituting the samples. Thus, it will be appreciated that the temperature reached at the beginning of the exothermic phenomenon is the lowest temperature applied to the getter material; that is, the triggering temperature of the getter system.

Figure 12:
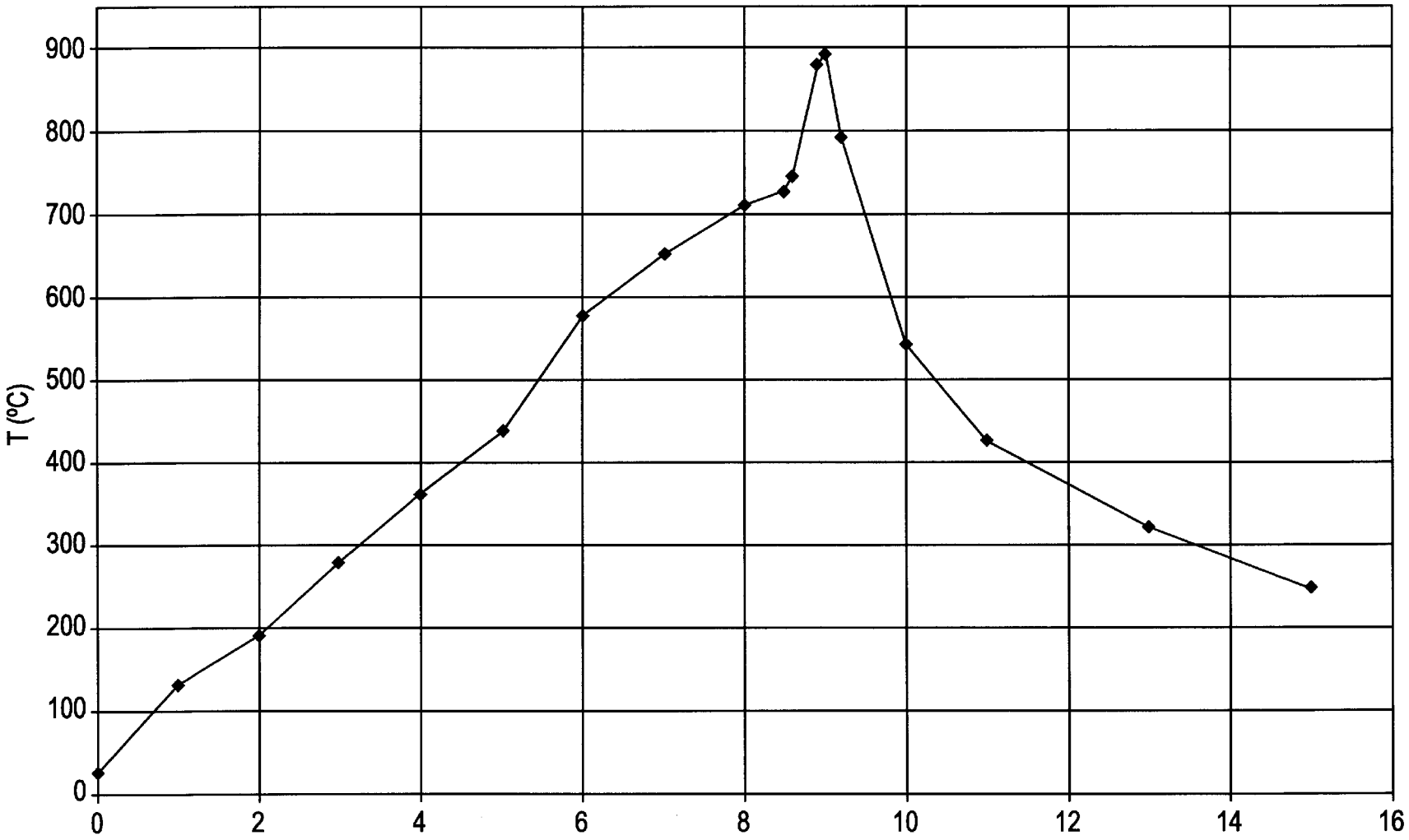
FIG. 12 is a graph showing the temperature profile of a combination of materials of the prior art as a consequence of heating.

A comparison of the graphs of FIGS. 7–11 and the results in Table 1 with the graph of FIG. 12, indicate that the exothermic reaction is triggered in the inventive combinations at temperatures between about 280° C. and about 475° C., while in the above-cited Japanese patent application this reaction is triggered at a temperature of about 730° C. Considering that the activation of pure titanium starts a little above 500° C., it is clear that in the above-cited Japanese application the exothermic reaction does not activate the getter at a temperature lower than that required for activation of the getter material alone. Indeed, in this case one can possibly see little, if any, advantage to activating the getter material using this system as the activation is mostly carried out by external heating.

Figure 13:
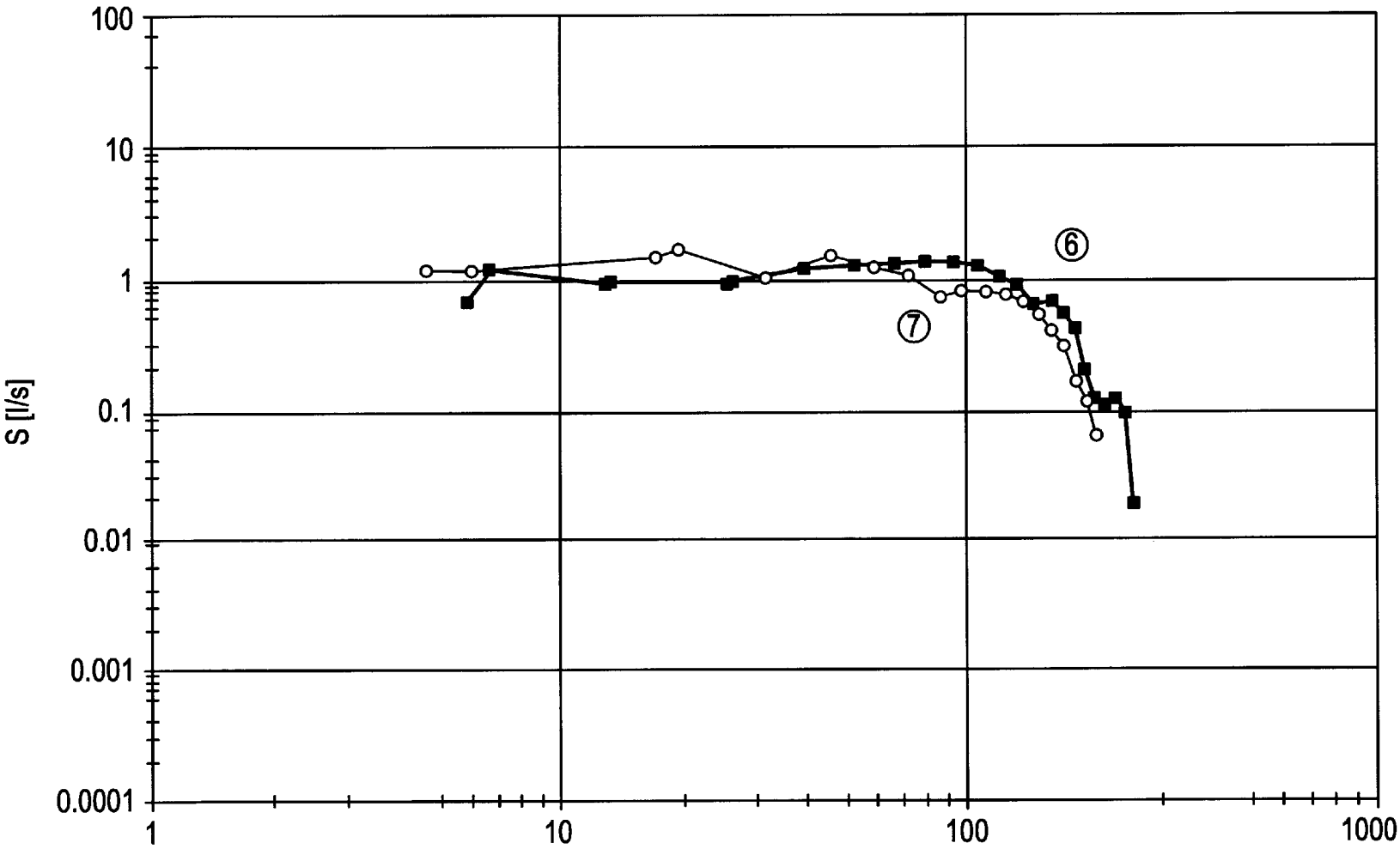
FIG. 13 is a graph showing, on a double logarithmic scale, the hydrogen ($H_2$) sorption lines for two tablets of NEG material, one of which is activated according to the procedures according to the invention and the other of which is activated according to a conventional method. The gas sorption rate (S) is recorded along the ordinate; the sorbed gas quantity (Q) is recorded along the abscissa.
Figure 14:
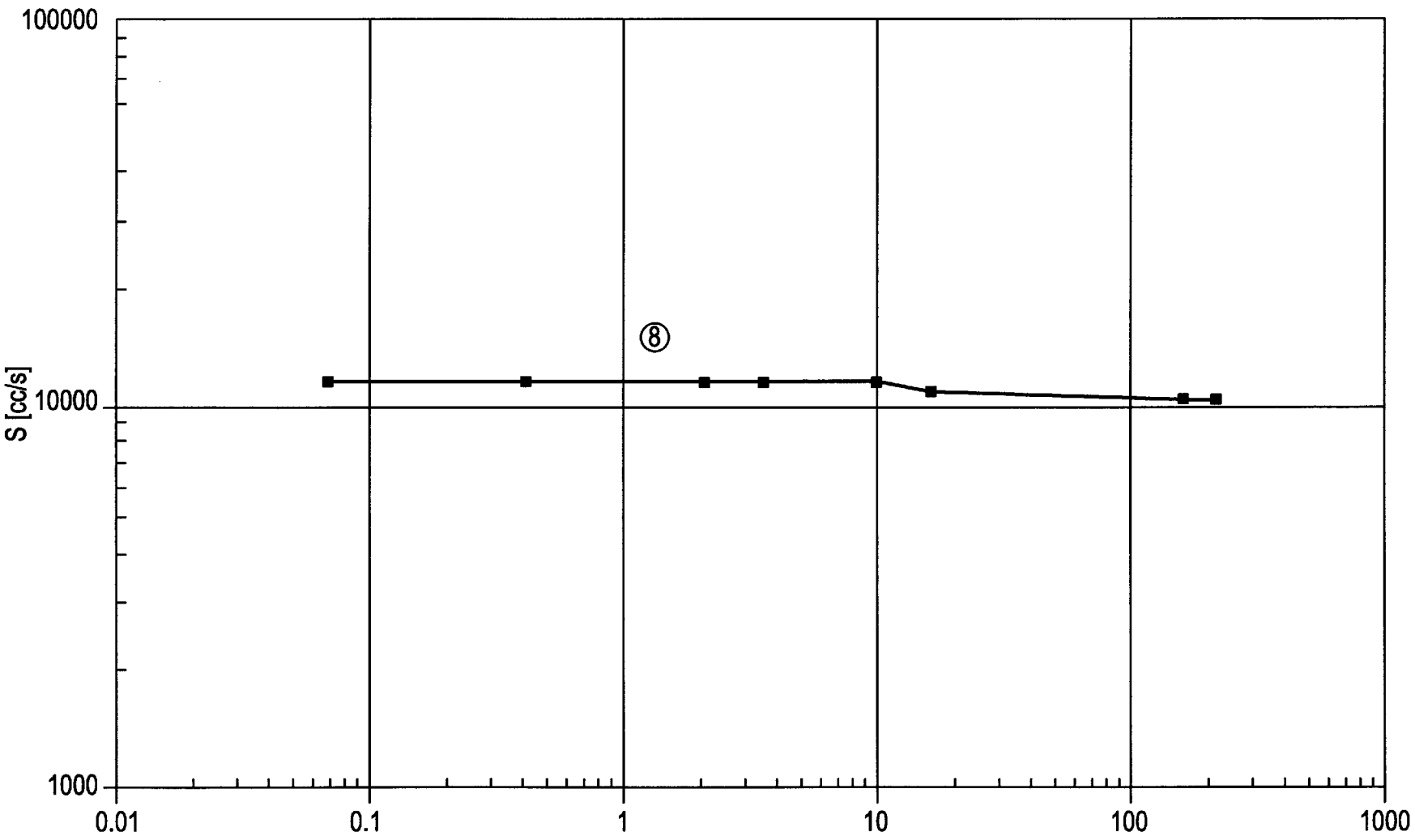
FIG. 14 shows a carbon monoxide (CO) sorption line, as described for FIG. 13, for a barium film evaporated in accordance with the methods and materials of present invention.

The temperatures reached by the getter systems of the invention are sufficient for activating both the evaporable getters and the non-evaporable getters. This is confirmed by the analysis of FIGS. 13 and 14. In FIG. 13, line 6 shows the gas sorption carried out by the 700 mg of St 707 alloy activated by means of an inventive combination; whilst line 7 shows the gas sorption for the same amount of St 707 alloy activated using conventional methods. The sorption lines relating to equal amounts of getter alloy activated by means of the two methods are substantially overlap each other, demonstrating that in each case the getter material has been activated. In FIG. 14 a gas sorption line is shown for a barium film evaporated by heating at 300° C. a precursor comprising an inventive combination. Also in this case, the barium film evaporated by heating the system with an external source at 300° C. shows good sorption properties; whilst the evaporation according to the conventional method requires temperatures higher than 800° C. These results demonstrate that the materials and methods of the present invention are effective in getter alloy activation at applied temperatures that are lower than required for the getter material alone.

In addition, using the methods and materials described herein it is possible to control the external applied temperature required for the activation of a getter material by varying parameters such as the chemical nature of the components of the triggering combination, their weight ratio, the powder particle size and the contact surface between the combination of the invention and the getter material. In particular, the external applied temperature for activation may be chosen over a certain lower limit, e.g., between about 280° C. and about 500° C. Also, the present invention will be seen to provide materials and methods useful in situations where it is desired to avoid applied activation temperatures higher than a preset limit, but lower than a maximum temperature, as, for example, in the production of television tubes where it is desirable to keep the degree of external heating to a level lower than about 850° C. (required by the conventional activation methods), but higher than about 450° C., so that the getter material will not be activated during the tube sealing step.

Thus, the present invention will be seen to provide materials, devices, and methods that are effective for providing activated getter materials at low applied temperatures. Such materials will be seen to be valuable for use in devices for which external heating to high temperatures, such as required to activate the getter elements without the use of the materials described herein, can damage or otherwise impair the function of other materials and/or other devices in the space being evacuated by the getter material.

Although certain embodiments and examples have been used to describe the present invention, it will be apparent to those having skill in the art that various changes can be made to those embodiment and/or examples without departing from the scope or spirit of the present invention. For example, although various alternative embodiments have been described herein those of skill in the art will realize that many more alternative getter materials, activator materials, and alloy can be used in accordance with the teachings and illustrations provided herein. In addition, those of skill in the art will realize that these components can be combined and utilized in many ways that are in accordance with the teachings and illustrations provided herein.

What is claimed:

1. A getter composition that can be activated at a low applied temperature, comprising:

a getter component selected from the group consisting of evaporable getter materials, titanium-based non-evaporable getter materials, and zirconium-based non-evaporable getter materials; and an activator component selected from the group consisting of $Ag_2O$, CuO, $MnO_2$, $Co_3O_4$, and mixtures thereof.

2. The getter composition of claim 1, wherein said getter component is an evaporable getter material.

3. The getter composition of claim 1, wherein said getter component comprises the alloy $BaAl_4$.

4. The getter composition of claim 1, wherein said getter component and said activator component comprise powders having an average particle size less than about 150 μm.

5. The getter composition of claim 4, wherein said getter component and said activator component comprise powders having an average particle size less than about 50 μm.

6. The getter composition of claim 4, wherein said powder of said getter component and said activator component comprise a substantially homogeneous mixture.

7. The getter composition of claim 1, further comprising an alloy having a first component selected from the group consisting of rare earth metals, Y, La, and mixtures thereof, and a second component selected from the group consisting of Cu, Sn, and mixtures thereof.

8. The getter composition of claim 7, wherein said getter component and said activator component comprise powders having an average particle size less than about 150 μm.

9. The getter composition of claim 8, wherein said getter component and said activator component comprise powders having an average particle size less than about 50 μm.

10. The getter composition of claim 8, wherein said powders of said getter component and said activator component comprise a substantially homogeneous mixture.

11. The getter composition of claim 7, wherein said getter component and said activator component are combined in a weight ratio of between about 10:1 and about 1:1.

12. The getter composition of claim 11, wherein said ratio is between about 5:1 and about 1:1.

13. The getter composition of claim 11, wherein said getter component is a zirconium-based non-evaporable getter material.

14. The getter composition of claim 13, wherein said zirconium-based non-evaporable getter material includes at least one material selected from the group consisting of V, Cr, Mn, Fe, Co, Ni, Al, Ta, and W.

15. The getter composition of claim 14, wherein said zirconium-based non-evaporable getter material is selected from the group consisting of Zr—Al, Zr—Fe, Zr—Ni, Zr—Co, Zr—V—Fe, and Zr—Mn—Fe alloys.

16. The getter composition of claim 15, wherein said zirconium-based non-evaporable getter material is a ternary alloy having the composition, by weight, Zr 84%—Al 16%, a binary alloy having the composition, by weight, Zr 76.6%—Fe 23.4%, or a binary alloy having the composition, by weight, Zr 75.7%—Ni 24.3%.

17. A getter composition that can be activated at low applied temperature, comprising:

a getter component selected from the group consisting of evaporable getter materials, titanium-based non-evaporable getter materials, and zirconium-based non-evaporable getter materials; and an activator component that is effective to heat said getter component to a temperature greater than about 500° C. when said activator component is heated to a temperature of between about 280° C. and about 500° C., said activator component being selected from the group consisting of $Ag_2O$, CuO, $MnO_2$, $Co_3O_4$, and mixtures thereof.

18. The getter composition of claim 17, wherein said getter component is a zirconium-based non-evaporable getter material.

19. The getter composition of claim 17, wherein said getter component is an evaporable getter material.

20. The getter composition of claim 17, wherein said activator component is effective to heat said getter material to a temperature greater than about 1,000° C.

21. The getter composition of claim 17, further comprising an alloy having a first component selected from the group consisting of rare earth metals, Y, La, and mixtures thereof, and a second component selected from the group consisting of Cu, Sn, and mixtures thereof.

22. The getter composition of claim 21, wherein said getter component is a zirconium-based non-evaporable getter material.

23. The getter composition of claim 21, wherein said getter component is an evaporable getter material.

24. The getter composition of claim 17, wherein said getter component is a zirconium-based non-evaporable getter material.

25. The getter composition of claim 24, wherein said zirconium-based non-evaporable getter material includes at least one material selected from the group consisting of V, Cr, Mn, Fe, Co, Ni, Al, Ta, and W.

26. The getter composition of claim 25, wherein said zirconium-based non-evaporable getter material is selected from the group consisting of Zr—Al, Zr—Fe, Zr—Ni, Zr—Co, Zr—V—Fe, and Zr—Mn—Fe alloys.

27. The getter composition of claim 26, wherein said zirconium-based non-evaporable getter material is a ternary alloy having the composition, by weight, Zr 84%—Al 16%, a binary alloy having the composition, by weight, Zr 76.6%—Fe 23.4%, or a binary alloy having the composition, by weight, Zr 75.7%—Ni 24.3%.

28. The getter composition of claim 24, wherein said getter component and said activator component comprise powders having an average particle size less than about 150 $\mu$m.

29. The getter composition of claim 28, wherein said getter component and said activator component comprise powders having an average particle size less than about 50 $\mu$m.

30. The getter composition of claim 29, wherein said getter component and said powders of said activator component comprise a substantially homogeneous mixture.

31. The getter composition of claim 1, wherein said getter component is an evaporable getter material.

32. The getter composition of claim 31, wherein said getter component comprises the alloy $BaAl_4$.

33. The getter composition of claim 32, wherein said getter component and said activator component comprise powders having an average particle size less than about 150 $\mu$m.

34. The getter composition of claim 33, wherein said getter component and said activator component comprise powders having an average particle size less than about 50 $\mu$m.

35. The getter composition of claim 34, wherein said powder of said getter component and said activator component comprise a substantially homogeneous mixture.

* * * * *